United States Patent [19]

Kimoto

[11] Patent Number: 4,838,405

[45] Date of Patent: Jun. 13, 1989

[54] COIN CHECKING DEVICE FOR DISCRIMINATING DENOMINATION OF A COIN AND DETECTING A COIN ABNORMALITY

[75] Inventor: Toyoki Kimoto, Urawa, Japan

[73] Assignee: Laurel Bank Machines Co., Ltd., Tokyo, Japan

[21] Appl. No.: 137,373

[22] Filed: Dec. 23, 1987

[30] Foreign Application Priority Data

Dec. 29, 1986 [JP] Japan ..... 61-200869[U]

[51] Int. Cl.[4] ..... G07D 5/08

[52] U.S. Cl. ..... 194/318; 453/3; 73/163

[58] Field of Search ..... 194/317, 318, 319, 320; 453/3; 73/163; 324/227, 236, 262, 202; 209/546, 548, 549, 534

[56] References Cited

U.S. PATENT DOCUMENTS

| | | | |
|---|---|---|---|
| 4,234,071 | 11/1980 | Le-Hong | 194/317 |
| 4,460,004 | 7/1984 | Furuya | 194/317 X |
| 4,492,296 | 1/1985 | Dubey | 194/318 |
| 4,538,719 | 9/1985 | Gray et al. | 194/317 |
| 4,572,349 | 2/1986 | Furuya et al. | 194/318 |
| 4,718, 558 | 1/1988 | Castaneda | 209/587 X |
| 4,749,074 | 6/1988 | Ueki et al. | 194/317 |

FOREIGN PATENT DOCUMENTS

| | | | |
|---|---|---|---|
| 59-111587 | 6/1984 | Japan . | |
| 0004037 | 9/1985 | World Int. Prop. O. | 194/317 |

*Primary Examiner*—Joseph J. Rolla
*Assistant Examiner*—Edward S. Ammeen
*Attorney, Agent, or Firm*—Fleit, Jacobson, Cohn, Price, Holman & Stern

[57] ABSTRACT

A coin discriminating device which can carry out accurate coin discrimination free of error caused by drift and changes in the thermal characteristics of the detecting elements. The coin type is discriminated by detecting data on the magnetic characteristics of coins and comparing the detected data with reference data and also by computing the difference between the maximum and minimum values of the detected data and comparing the computed result with the reference value.

4 Claims, 6 Drawing Sheets

COIN CHECKING DEVICE FOR DISCRIMINATING DENOMINATION OF A COIN AND DETECTING A COIN ABNORMALITY

BACKGROUND OF THE INVENTION

The present invention relates to a coin discriminating device.

Heretofore, there have been coin discriminating devices, for example as shown in Japanese Laid-Open Patent Publication No.111587/1984.

This coin discriminating device includes primary and secondary coils arranged on opposite sides of a coin passage and is adapted to carry out the discrimination of the genuineness of a coin by inputting, via an amplifier, the voltage, induced in the secondary coil when the primary coil is excited by an oscillation circuit, to a comparator and then by comparing the induced voltage with a reference voltage predetermined with reference to each coin type (or coin material).

The level of the signal inputted to the comparator is influenced by drift and the thermal characteristics of the amplifiers used for the oscillation circuit to drive the primary coil and for amplifying the signals of the secondary coil and also by the aging of the amplifiers and coils. For overcoming this problem, one way is to expand the allowable range of the reference voltage in the comparator in anticipation of the level variation of the input signal. However, expansion of the allowable range of the reference voltage can often erroneously discriminate a counterfeit coin as a genuine one.

SUMMARY OF THE INVENTION

Accordingly, it is an object of the present invention to provide a coin discriminating device which can carry out accurate coin discrimination without error due to the influences of the drift and thermal characteristics of the detecting elements.

For achieving the object of the present invention, there is provided, as shown in FIG. 7, a coin discriminating device comprising magnetic detecting means "a" for detecting magnetic characteristics of a coin; coin type discriminating means "b" for discriminating the type of said coin by comparing data from said magnetic detecting means with reference data; detected level storing means "c" for storing the data detected by said magnetic detecting means; and dispersion abnormality detecting means "d" for comparing the difference between the maximum and minimum values of each coin type in the detected data stored in said detected level storing means with a reference value.

According to the coin discriminating device of the present invention, since the process of computing the difference between the maximum and minimum values from the separately stored data of coin types in the detected level storing means and also the process of comparing the computed result with the reference value are carried out in addition to the coin type discriminating process, the accuracy of the discrimination can be remarkably increased.

BRIEF DESCRIPTION OF THE DRAWINGS

Other objects and advantages of the present invention will become apparent from the following detailed description of a preferred embodiment of the present invention with reference to the accompanying drawings in which.

DESCRIPTION OF THE PREFERRED EMBODIMENT

Figure 1:
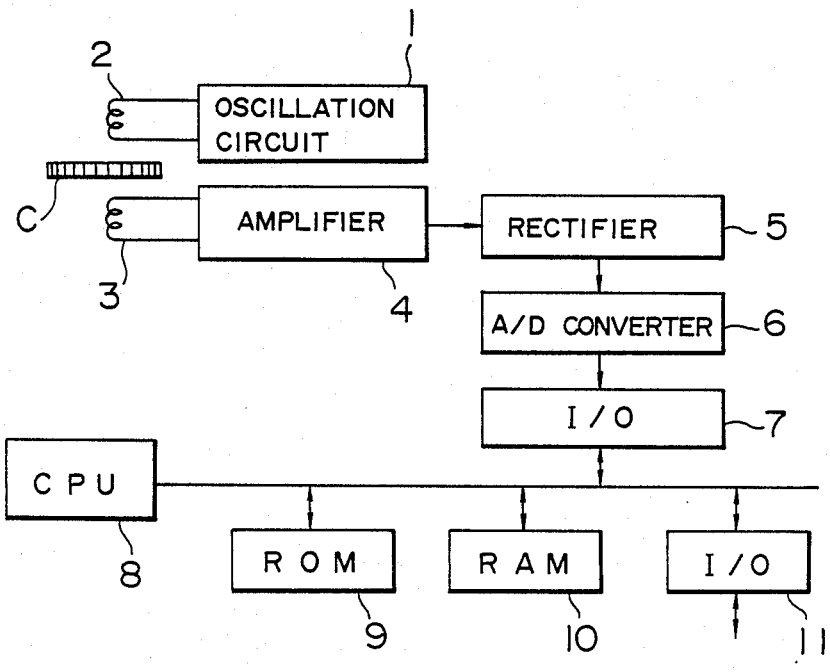
FIG. 1 is a block diagram showing a first embodiment of a coin discriminating device of the present invention.

With reference to FIG. 1, a primary coil 2 connected to an oscillating circuit 1 is arranged opposite to a secondary coil 3. A coin C is carried, for example on a conveyor (not shown) and moved horizontally in FIG. 1 along a coin passage formed between the primary and secondary coils 2 and 3. The secondary coil 3 is connected to an amplifier 4. An output from the amplifier 4 is input to an A/D (analog-to-digital) converter 6 via a rectifier 5 and is converted to a digital signal which is input to a CPU (central processing unit) 8 via an I/0 (input-output port) port 7. Also connected to the CPU 8 are a ROM (read-only memory) 9 containing a control program for the CPU 8, a RAM (random access memory) 10 for storing detected data and reference data used for discrimination, and an I/0 port 11 for supplying control signals output from the CPU 8 to other instruments and for receiving signals from an input means such as a keyboard.

Figure 2:
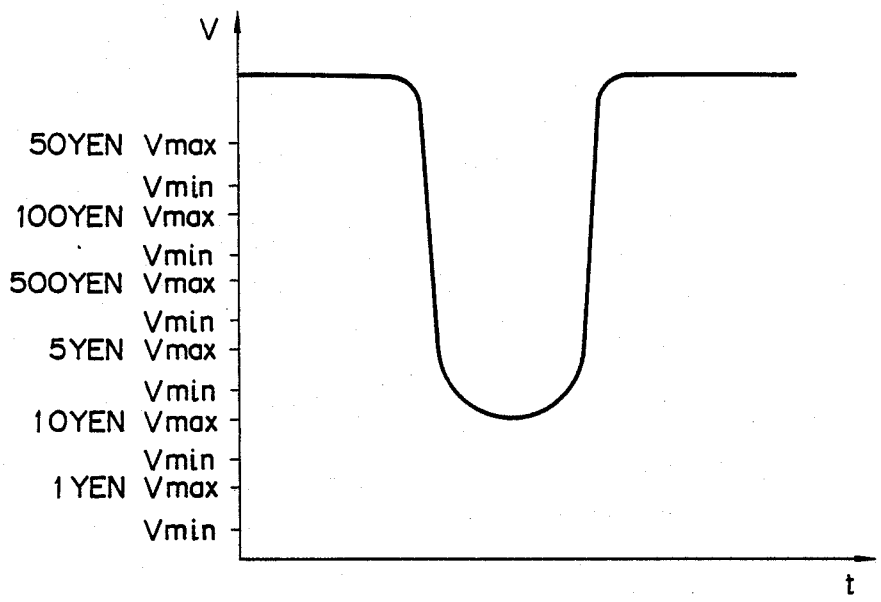
FIG. 2 is a diagram showing of a detected signal wave form.

When the coin C is passed through the region between the primary and secondary coils 2 and 3 (hereinafter called a "detecting zone"), the level "V" of the detected signal varies with the lapse of time "t" as shown in FIG. 2. That is, the signal level V gradually decreases as the coin C enters the detecting zone, becoming a minimum when the coin C reaches the center of the detecting zone, and then gradually increases as the coin C moves away from the center of the detecting zone. When the coin C completely leaves the detecting zone, the signal level becomes constant and essentially the same as that before the coin C entered the detecting zone. Since each ($V_{min}-V_{max}$) minimum signal level range is previously determined with respect to each coin type, for example, 1 yen, 5 yen, 10 yen, 50 yen, 100 yen, and 500 yen, it is possible to discriminate the type of coin by identifying the range $V_{min}-V_{max}$ to which the detected minimum signal level belongs.

Figure 4:
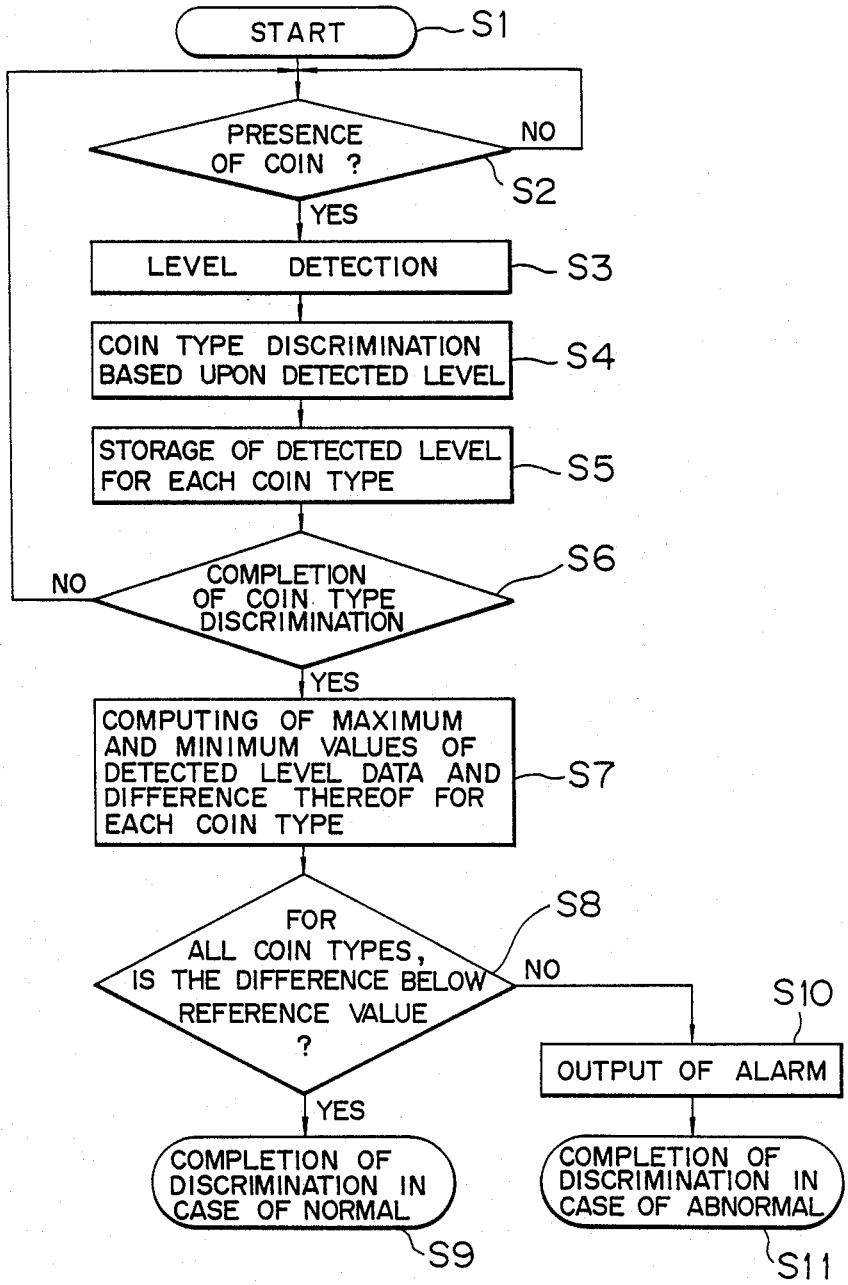
FIG. 4 is a flowchart showing CPU operation.

The control carried out by the CPU 8 will now be described with reference to the flowchart of FIG. 4. In this flowchart, "Sn" denotes the nth step.

Sl: The discriminating operation is started by switching on the discriminating device and by introducing a coin C into the detecting zone.

S2: Discrimination of whether a coin is present in the detecting zone. This discrimination is carried out, for example, by detecting the variation of the signal level output from the secondary coil 3. If the response is "YES", the procedure moves to the following step, S3.

S3: Detection of a minimum output of the secondary coil 3 and input of this detected signal level to the CPU 8.

S4: Discrimination of the type of coin based upon which of the ranges in FIG. 2 the detected level belongs to.

S5: Storing the detected levels for each type of coin in the RAM 10.

S6: When the output signal level from the secondary coil 3 does not vary over a predetermined interval, it is judged that the discrimination of all coins is completed, and the procedure moves to step S7. If the discrimination of all coins is not yet completed, the procedure reverts to step S2 and repeats steps S2 to S5.

S7: Reading out of the detected level data from the RAM 10 and finding maximum value $D_{max}$, minimum value $D_{min}$ and the level difference $\Delta D$ ($=D_{max}-D_{min}$) by coin type. In this step, the level difference of each coin type $\Delta D_1$, $\Delta D_5$, $\Delta D_{10}$, $\Delta D_{50}$, $\Delta D_{100}$ and $\Delta D_{500}$ is computed (hereinafter these level differences $\Delta D_l$ or $D_{500}$ are referred to as "$\Delta D_n$").

Figure 3:
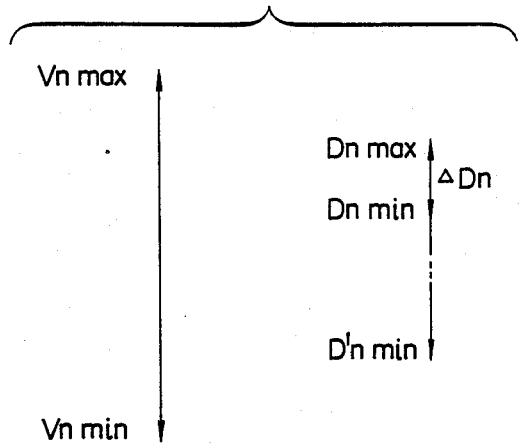
FIG. 3 is a diagram showing the relation between reference range and detected signal level.

S8: Comparison of computed level difference $\Delta D_n$ with a level difference $\Delta L_n$ which is the level difference when all coins of a certain type are genuine (the level difference $\Delta L_n$found by experiment and stored beforehand in the ROM 9 or the RAM 10). In the case of YES ($\Delta D_n \leqq \Delta L_n$), it is determined that no unacceptable coins such as a counterfeit coin are intermingled, and the procedure moves to step S9, in which the operation is completed. On the other hand, in the case of NO ($\Delta D_n > \Delta L_n$), it is determined that diffferent types of coins or counterfeit coins are intermingled, and the procedure moves to step S10. According to the coin discriminating device of the present invention, since a range $V_{nmax}$ or $V_{nmin}$ of the detected signal level (a coin falling within this range being discriminated as genuine) is set sufficiently broader than the range $\Delta D_n$ of the detected data obtained from actual measurement of the genuine coins as shown in FIG. 3 and the value of $\Delta D_n$ is compared with the reference value after the discimination of all coins, the difference between $D'_{nmax}$ and $D_{nmin}$ is small, as shown by a solid line in FIG. 3, when all coins are genuine. On the contrary, an extremely small (or an extremely large) detected level $D'_{nmin}$ is obtained as shown by a dotted line in FIG. 3 when at least one counterfeit coin is intermingled therein. Thus, it can be detected that there are counterfeit coins mixed in by comparing $\Delta D_n$ with $\Delta L_n$.

S10: An alarm signal is output to drive a warning means (not shown) informing that the counterfeit coin is intermingled. The abnormality detecting operation is thus completed.

Sll: When an abnormality is detected, it is discriminated whether it is a different type of coin or a counterfeit coin that is intermingled with the coins which have been discriminated. In such a case, it is preferable that, for example, ① the coin is returned, ② the discriminating operation is repeated, ③ visual confirmation is made, and the like. Even if, with the passage of time, drift or characteristics changes should arise in the oscillator 1, primary and secondary coils 2 and 3 and amplifier 4, this has little influence on the difference between the maximum value $D_{max}$ and the minimum value $D_{min}$ in accordance with the present invention. This makes it possible to prevent erroneous operation in the discriminating device.

Figure 5:
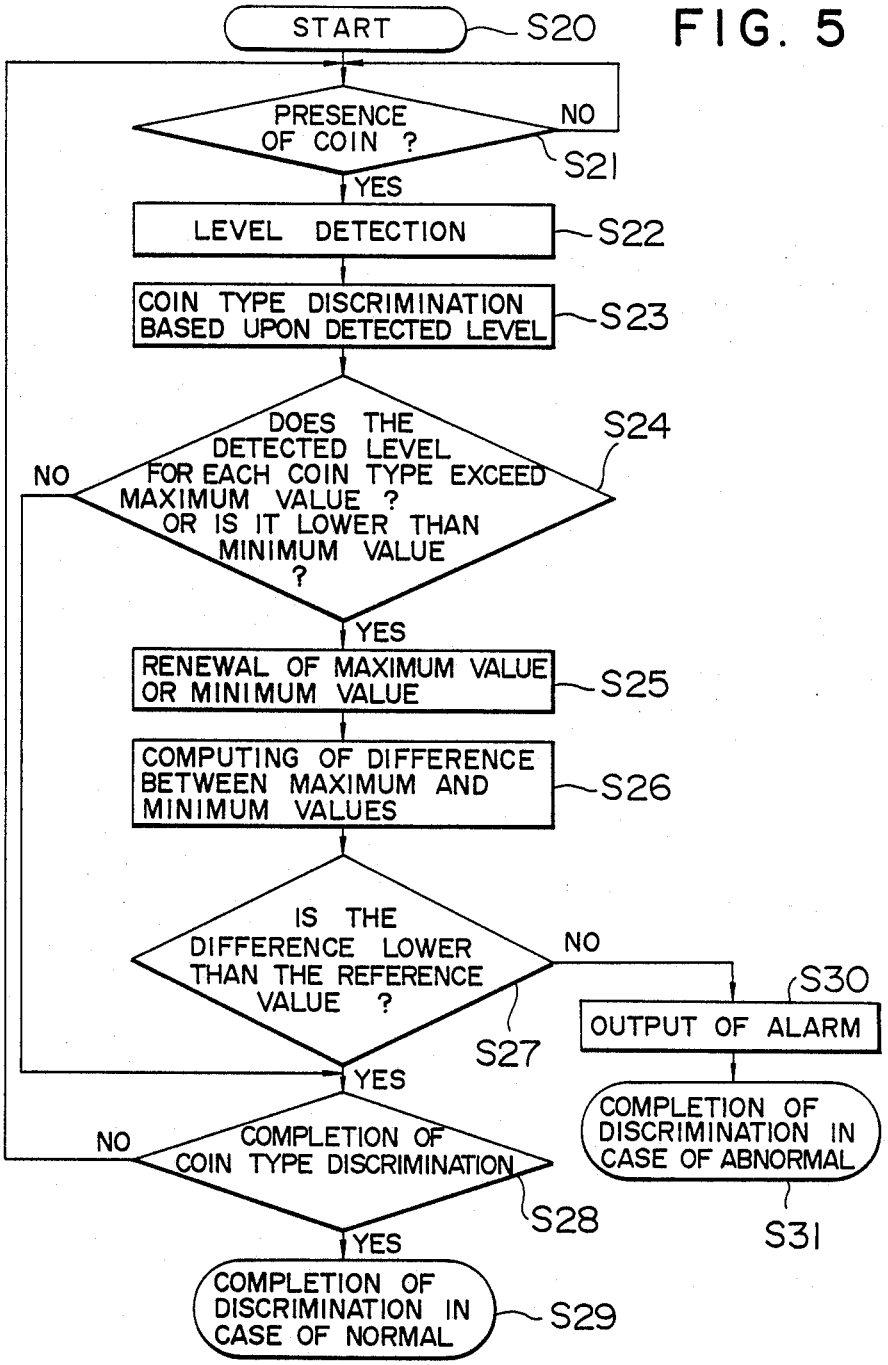
FIG. 5 is a flowchart showing the operation of a second embodiment of the present invention.

The discriminating operation of another embodiment is described below with reference to FIG. 5.

S20: Discriminating operation starts.

S21: Discrimination of whether a coin is present in the detecting zone. This discrimination is carried out, for example, by detecting the variation of the signal level output from the secondary coil 3. If the response is "YES", the procedure moves to the following step, S22.

S22: Detection of a minimum output of the secondary coil 3 and input of this detected signal level to the CPU 8.

S23: Discrimination of the type of coin based upon which of the ranges in FIG. 2 the detected level belongs to.

S24: Discrimination of whether the detected level $D_n$used or discrimination of coin type exceeds the preceding maximum detected level $D_{nmax}$ or is lower than the minimum detected level $D_{nmin}$. If the level $D_n$ exceeds the level $D'_{nmax}$ or is lower than the level $D'_{nmim}$ (YES), the procedure moves to the following step S25. In the case of NO, it goes to step S28.

If a long period of time has not elapsed since the last discrimination, the values $D_{nmax}$ and $D_{nmim}$ stored in the RAM 10 in the last discrimination may be used for the initial values of $D_{nmax}$ and $D_{nmim}$ of tiis discrimination. Alternatively, the values $D_{nmax}$ and $D_{nmim}$ found by experiment can be pre-stored in the RAM 10, and can be written to a specific area of the RAM 10 as initial values simultaneously with the start of the discrimination operation (for example, at the step S21).

S25: Rewriting of the data of $D_{nmax}$ or $D_{nmim}$ in the RAM 10.

S26: Reading out of the values $D_{nmax}$ and $D_{nmim}$ from the RAM 10 and finding the level difference $\Delta D_n$ (i.e. $D_{nmax}-D_{nmim}$) for each coin type.

S27: Comparison of the computed level difference $\Delta D_n$with a level difference $\Delta L_n$ found by experiment and stored in the RAM 10. In the case of YES ($\Delta D_n \leqq \Delta L_n$), it is determined that no unacceptable coins such as counterfeit coins are intermingled, and the procedure moves to step S28. On the other hand, in case of NO ($\Delta D_n > \Delta L_n$), it is determined that different types of coins or counterfeit coins are intermingled, and the procedure moves to step S30.

coil 3 does not vary over a predetermined interval (YES), it is judged that the discrimination of all coins is completed, and the operation proceeds to step S29. On the contrary, when the level has varied (NO), it is judged that discrimination of all coins is not yet completed and operation reverts to step S21.

S30: An alarm signal is output to drive a warning means (not shown) informing that the counterfeit coin is intermingled. The abnormality detecting operation is thus completed (S31).

Figure 6:
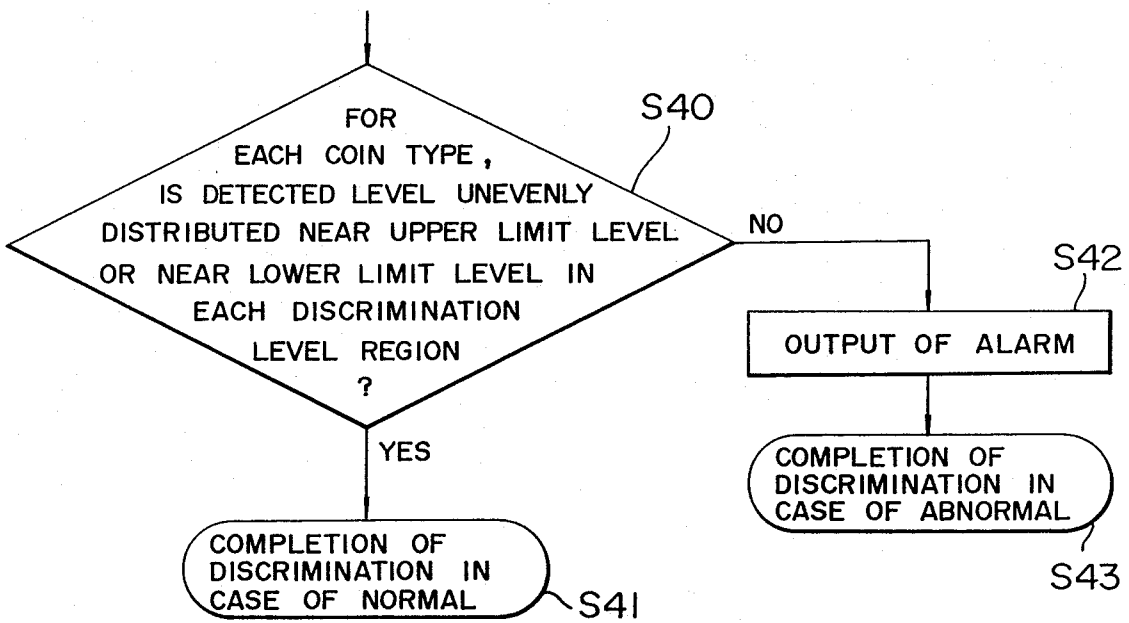
FIG. 6 is a flowchart showing a part of the discriminating operation of a third embodiment of the present invention.
Figure 7:
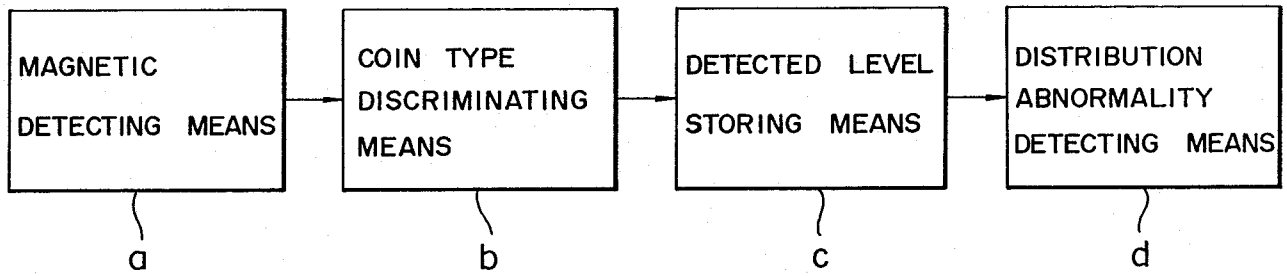
FIG. 7 is a block diagram showing a fundamental constructioin of the coin discriminating device of the present invention.

In the coin discriminating operations of the first and second embodiments, the abnormality detecting operation of specific coin types cannot be performed without obtaining the maximum and minimum level values data for the corresponding coin types. Thus, it is impossible to carry out the coin discriminating operation when there is only one sample (coin). However, the addition of the coin discriminating operation shown in the flowchart of FIG. 6 after step S8 in the first embodiment and step S28 or S29 makes it possible to carry out the abnormality detecting operation in such a case, as described below with reference to FIG. 6.

S40: Discrimination of whether the detected levels in each coin type are unevenly distributed near the upper limit level ($V_{nmax}$) of the reference level or near the lower limit level ($V_{nmin}$) thereof. When the data of all coin types are unevenly distributed on either of these limit levels, it is determined that the discrimination operation has proceeded normally and thus the operation is completed (S41). On the contrary, when any other tendency has been found in respect of either of the above, it is determined that counterfeit coins are intermingled, and thus the operation is completed (S43) after an alarm signal is output (S42).

According to the coin discriminating device of the present invention, the coin type is discriminated by detecting data relating to the magnetic characteristics of coins and comparing the detected data with reference data, and also by computing the difference between the maximum and minimum values of the detected data to compare the computed result with reference values. Thus, it is possible to prevent erroneous detection produced by drift and changes in thermal characteristics of the measuring instruments and therefore to carry out accurate coin discrimination.

What we claimed is:

1. A coin checking device for discriminating demonination of coins and detecting a coin abnormality, said coin checking device comprising:

magnetic detecting means for detecting magnetic characteristics of each coin introduced into the coin checking device, coin sorting means for comparing a level signal denoting the magnetic characteristics detected by said magnetic detecting means for each coin against a predetermined sorting reference level zone for each denomination of coins and storing said level signal in accordance with the determined denomination of each coin, differential calculating means for finding a maximum value and a minimum value of said level signals stored in said coin sorting means for each denomination of coin and determining a difference between said maximum value and said minimum value of said level signals for each denomination of coins, and coin abnormality detecting means for comparing said difference between said maximum value and said minimum value of said level signals for each denomination of coins against a different predetermined abnormality reference value for each of the denominations of coins and judging an abnormality of the coins for a particular denomination of coins when said difference between said maximum value and said minimum value of said level signals in said particular denomination is greater than said abnormality reference value for said particular denomination.

2. A coin checking device in accordance with claim 1, wherein said coin abnormality detecting means determines coins to be genuine when said level signals of a specific denomination of coins are grouped at an upper limit or a lower limit of a particular sorting reference level zone.

3. A coin checking device for discriminating denomination of coins and detecting a coin abnormality, said coin checking device comprising:

magnetic detecting means for detecting magnetic characteristics of each coin introduced into the coin checking device, a coin sorting means for comparing a level signal denoting the magnetic characteristics detected by said magnetic detecting means for each coin against a predetermined sorting reference level zone for each denomination of coins and storing a maximum value and a minimum value of said level signals in accordance with a particular denomination of coins, and replacing said maximum value by a newly detected level signal when said newly detected level signal is greater than said maximum value and replacing said maximum value by a newly detected level signal when said newly detected level signal is less than said minimum value, differential calculating means for calculating a difference between said maximum value and a minimum value of said level signals stored in said coin sorting means for each denomination of coins, and coin abnormality detecting means for comparing said difference between said maximum value and a minimum value of said level signals for each denomination of coins against a different predetermined abnormality reference value predetermined for each of the denominations of coins and judging an abnormality for a particular denomination of coins when said difference between said maximum value and said minimum value of said level signals in said particular denomination is greater than said abnormality reference value for said particular denomination.

4. A coin check device in accordance with claim 3, wherein said coin abnormality detecting means determines coins to be genuine when said level signals of a specific denomination of coins are grouped at an upper limit or a lower limit of a particular sorting reference level zone.

* * * * *